United States Patent [19]

Odenthal

[11] Patent Number: 4,564,051

[45] Date of Patent: Jan. 14, 1986

[54] MULTIPLE PLY DEWATERING SCREEN PARTICULARLY FOR A WEB FORMING PART OF A PAPER MAKING MACHINE

[75] Inventor: Heinz Odenthal, Monheim, Fed. Rep. of Germany

[73] Assignee: Andreas Kufferath GmbH & Co. KG, Dueren-Mariaweiler, Fed. Rep. of Germany

[21] Appl. No.: 631,936

[22] Filed: Jul. 12, 1984

[30] Foreign Application Priority Data

Jul. 16, 1983 [DE] Fed. Rep. of Germany ... 3325780[U]
Jul. 16, 1983 [DE] Fed. Rep. of Germany ..... 8320610

[51] Int. Cl.[4] ..... D03D 13/00

[52] U.S. Cl. ..... 139/425 A; 139/383 A; 162/348; 162/DIG. 1; 428/223; 428/225; 428/257

[58] Field of Search ..... 162/348, 349, DIG. 1; 139/383 A, 425 A; 428/221, 222, 223, 224, 225, 257

[56] References Cited

U.S. PATENT DOCUMENTS

| | | | |
|---|---|---|---|
| 3,127,308 | 3/1964 | Justus et al. | 162/349 |
| 3,214,326 | 10/1965 | Lee | 139/383 A |
| 4,105,495 | 8/1978 | Pai | 162/348 |
| 4,314,589 | 2/1982 | Buchanan et al. | 139/383 A |
| 4,470,434 | 9/1984 | Vuorio | 139/425 A |

FOREIGN PATENT DOCUMENTS

| | | | |
|---|---|---|---|
| 1003185 | 2/1957 | Fed. Rep. of Germany . | |
| 1758635 | 12/1957 | Fed. Rep. of Germany . | |
| 7438850 | 7/1975 | Fed. Rep. of Germany . | |
| 7703882 | 6/1977 | Fed. Rep. of Germany . | |
| 2627283 | 12/1977 | Fed. Rep. of Germany . | |
| 2917694 | 12/1979 | Fed. Rep. of Germany . | |
| 3036409 | 5/1982 | Fed. Rep. of Germany . | |
| 3225599 | 1/1984 | Fed. Rep. of Germany . | |
| 297738 | 4/1971 | U.S.S.R. | 162/DIG. 1 |

*Primary Examiner*—S. Leon Bashore
*Assistant Examiner*—Andrew J. Anderson
*Attorney, Agent, or Firm*—Michael J. Striker

[57] ABSTRACT

A paper web forming screen includes two screen fabric plies made of longitudinal and traverse filamentary elements. The upper ply is made of longitudinal and traverse mono- or multi- or staple-filaments whereas a part of longitudinal and/or traverse filamentary elements in the lower ply is made of mono- or multi- or staple-filaments and other parts of non-twisted bundles of component filaments. A component filament in respective bundles is passed at different tie points over traverse mono- or multi- or staple-filaments in the upper ply to replace a longitudinal mono- or multi- or staple-filament in the upper ply. The latter mono- or multi- or staple-filament is passed either below the traverse mono- or multi- or staple-filaments in the tie points or below traverse filaments in the lower ply. The component filaments in the bundles are of the same thickness as the longitudinal and traverse mono- or multi- or staple-filaments in the upper ply.

10 Claims, 11 Drawing Figures

PS
MS
MD
CD
A
B
I
II
III
T
Z
D
D'
10
11
12
20
21
22
23
3'
3''
3'''

MD
CD
A
10
11
12
20
22
23
3'
3''
3'''
3'';3'''

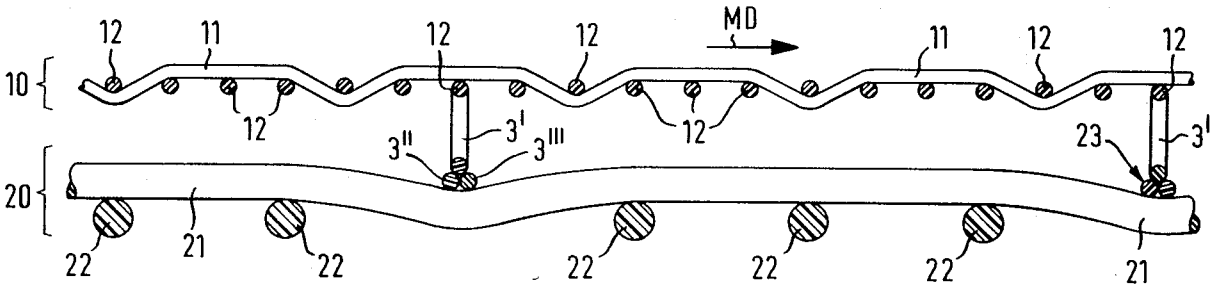
Fig. 9
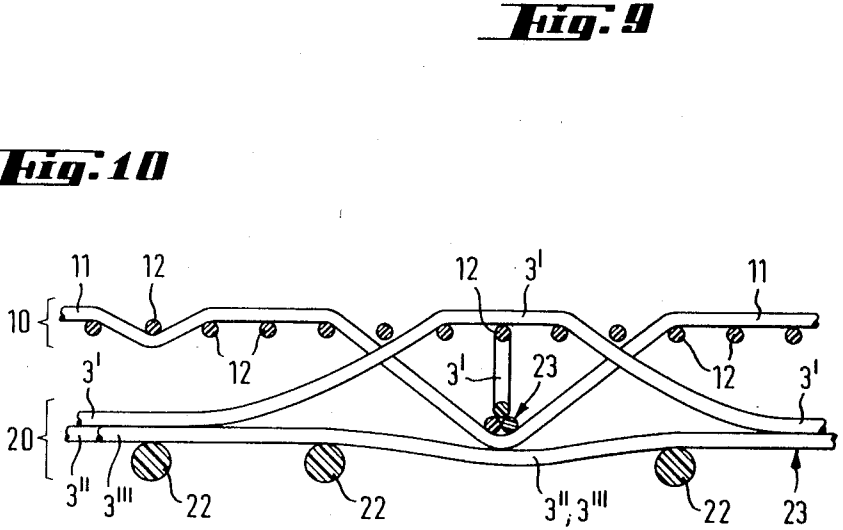
Fig. 11
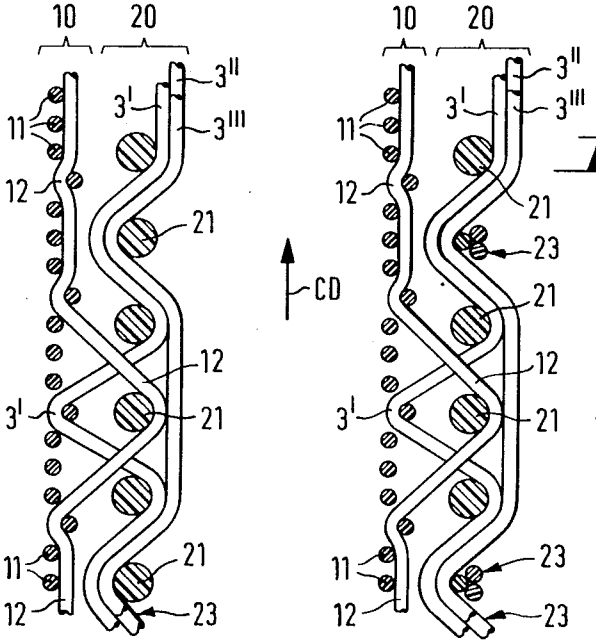
Fig. 10
Fig. 8

MULTIPLE PLY DEWATERING SCREEN PARTICULARLY FOR A WEB FORMING PART OF A PAPER MAKING MACHINE

BACKGROUND OF THE INVENTION

The present invention relates in general to a multilayer screen and in particular to a multiple ply screen for use particularly in a web forming part of a paper making machine. The screen is of the type which includes an at least two ply fabric made of longitudinal and transverse filamentary elements whereby the top side of the uppermost ply represents the upper side of the screen, and the lower side of the lowermost ply represents the lower side of the screen. The plies of the fabric are tied together at different tie points.

A dual wire dewatering screen of this kind is known from U.S. Pat. No. 3,127,308 where an upper ply of the screen fabric (outer wire loop) of relatively finer mesh woven in a plain weave, is connected with a lower ply (inner wire loop) of relatively coarse construction in a three-twill configuration (as a shute twill). The thickness of cross-section of the filaments in the lower wire loop or ply is greater than that of the filaments in the outer loop or upper ply. The upper side of the outer screen loop represents the forming wire on which a sheet or web fleece is made from the applied stuff suspension. The lower side of the inner wire loop forms the lower side of the run through which the dewatering screen engages processing parts of the paper making machine such as rollers, rolls, suction and draining devices past which the stuff suspension is carried by the circulating screen. In this known screen, the bind of the inner loop to the upper loop of the screen fabric is effected by several longitudinal or warp wires of the inner or lower fabric loop by guiding the latter in the outer or upper loop and interweaving the same with transverse or shute wires.

In this dual wire dewatering screen, the longitudinal wires of the lower screen loop form knuckles which pass under two transverse or shute wires. The warp wire knuckles thus are subject to tension present in the longitudinal direction of the sieve that is in the direction of a circulation and also to an increased wear or abrasion due to the contact with the before mentioned parts of the paper making machine. Both the tension and the wear negatively affect the service life of the screen. On the paper web forming side of this prior art dual wire apparatus, the tie points of the coarser web wires are raised above the forming wire and form projections. Due to the application of relatively thick warp or longitudinal filaments or wires in the upper ply of the screen texture, the uniformity of the structure of the upper side of the screen is disturbed and wire marks are reproduced in the mating surface of the paper web. The interference occurs in two respects, namely due to the presence of the filament or wire tie points by themselves which produce the before-described undesired projections on the paper web forming upper surface of the screen and secondly, due to the absence of warp tie points in the lower ply of the screen fabric there results weak or missing tie points in the weave. Because of these missing points the overall stability of the screen fabric and its strength are impaired. In addition a different dewatering affect takes place at these weak or missing tie points which can lead to the so-called hydraulic marking in the paper web.

From the German Gebrauchsmuster 7,438,850 a multi-layer or multi-ply dewatering screen is known having a relatively fine mesh and dense upper ply and relatively coarse-mesh and open lower ply and if desired, having additional intermediate plies of the screen fabric, which are bound together, by means of special, separate warp wires or filaments which are not a component of the weave of the screen fabric. These binding warp wires or filaments enclose at the tie-up points in the upper and lower plies of the screen fabric always one shute wire or filament.

In another known multi-ply dewatering screen (DE-OS 2,917,694) which also consists of a complete fine mesh upper ply and a complete coarse meshed lower ply of the screen fabric, for tying up the two plies there are employed separate shute tying wires or fibers instead of the separate warp tying wires. These separate shute binding filaments are linked so as to keep the position of the tie points from the outer sides of the sieve toward the inner sides of the latter. Inasmuch as the thickness or the cross-section of the binding wires or filaments are always less than the thickness or cross-section of the remaining warp and shute wires or filaments of the dewatering sieve, the raised tie points on the upper surface of the screen and thus the resulting disadvantageous indentation points in the paper web on the forming side of the screen, are avoided. The uniformity of the structure of the forming upper surface of the upper ply of the screen nevertheless is still subject to disturbances even in this prior art multi-ply dewatering screen due to the tie points of this additional binding wires or filaments. These tie points produce disadvantagous effects such as non-uniform retention and dewatering over the entire surface of the paper web during its formation as well as a non-uniform structure or markings on the web engaging the forming side of the sieve. Limits are set to the reduction of the number of the disturbing tying points because of the ensuing impairment of the stability of the multilayer dewatering screen. The possibility to reduce the thickness or the diameter of the binding wires or filaments is also limited inasmuch as at a given strength of material of the screen the reduction of the thickness of the binding filaments would produce an impaired binding between the plies of the screen fabric. In dewatering screens which consist of several, mutually independent complete fabric layers inter-connected by separate filaments, that means by binding filaments which do not belong to the woven fabric of the screen, particularly the binding filaments which extend traversely to the running direction of the screen are exposed to considerable shearing forces. This traverse load applied to relatively thin binding filaments leads frequently to breakage of the latter and the layers of the screen fabric become separated and the replacement of the entire dewatering screen becomes necessary. It has been also found that particularly in the dewatering screens of the type in which the binding filaments extend traversely to the running direction of the screen, a comparatively low resistivity against formation of waves in the screen occurs which also leads to frequent interferences or the necesssity to exchange the screen.

Known is also a double-layer dewatering screen (DE-OS 3,036,409) which avoids separate binding filaments and the disadvantages occuring in a double-layer dewatering screen fabric and which is constructed of an upper and lower layers shute or traverse filaments as well as of a layer of warp or longitudinal filaments; the shute filaments of both shute layers are superposed in pairs and the warp filaments are mostly interwoven in the upper layer and only a portion of the warp filaments is additionally tied to the lower shute layer whose shute filaments are preferably of a larger thickness than the warp filaments. According to the construction of the screen fabric in question, a single layer fabric is reinforced by a shute, namely by the so-called under shute system. It distinguishes therefore from the aforementioned multi-layer dewatering screens which have at least one shute filament- and one warp filament system per one layer. It is true that in this one-layer fabric reinforced by the under shute system the desired doubled-sided fabric is obtained within certain limits, nevertheless in view of warp filaments determining a marking free structure of the upper side of the screen, certain limitations with regard to the construction of the lower side of the screen cannot be avoided.

SUMMARY OF THE INVENTION

It is therefore a general object of the present invention to overcome the aforementioned disadavantages.

More particularly, it is an object of the invention to provide an improved dewatering screen of the aforedescribed kind which has an increased stability of the screen fabric resulting in a longer service life of the screen.

Another object of this invention is to provide such an improved multi-ply dewatering screen in which different working conditions can be applied to the forming upper side and also to the lower side of the screen, the sides being independent one from the other and being substantially free of disturbing irregularities at the binding or tying points.

In keeping with these objects and others which will become apparent hereafter, one feature of the invention resides the provision of an at least two-ply screen fabric made of longitudinal and traverse filamentary elements whereby the top side of the uppermost ply represents an upper side of the screen and the lower side of the lowermost ply represents a lower side of the screen; the plies of the fabric being tied together at different tie points; the longitudinal and traverse filamentary elements in the uppermost ply being single filaments; a part of the longitudinal and/or traverse filamentary elements in the lowermost ply being single filaments and another part of the filamentary elements in the lowermost ply being in the form of non-twisted bundles of component filaments, the cross-section of each bundle corresponding substantially to the cross-section of the single-piece filaments in the lowermost ply; said tie points between the plies being formed, respectively, by interweaving a component filament of a bundle with a crossing single filament in the uppermost ply and a single filament in the uppermost ply with a crossing filamentary element in the lowermost ply; and the cross-section of the component filaments interwoven in the uppermost ply corresponding substantially to that of the crossing single filaments in the uppermost ply.

By virtue of tying one of the component filaments of a bundle in the upper ply of the screen fabric while the remaining component filaments of this bundle remain bound in the lower-ply of the fabric (hence, no missing tie areas in the lower ply), a dewatering screen results which in its longitudinal and/or transverse direction has substantially improved stiffness and stability and thus a stable running behavior. Moreover, at the binding or tie points in the plies there is practically no difference in thickness. Inasmuch as the aforementioned limitations with regard to the construction of the uppermost as well as of the underlying plies of the screen fabric are not encountered in the solution according to this invention, the uppermost ply can be adjusted to special requirements layed on the paper web to be produced. For example it can be made fine meshed and dense and the lower ply of the fabric can be made independently from the upper ply so as to meet the following requirements:

increasing the service life of the screen, increasing of dewatering capacity and/or avoiding the susceptibility of the screen to folding, and adjusting the screen to particular operational conditions, such as for example by employing relatively thick longitudinal and traverse filaments producing a coarse and open screen.

No separate binding filaments for tying up the plies of the screen fabric are necessary. The screen of this invention has a substantially flat upper surface. Any raised or depressed areas at tie points are eliminated. With regard to the manufacture of the screen it is of advantage when the component filaments in the bundles are identical with the single longitudinal or traverse filaments in the uppermost ply. In this manner, any differences in the longitudinal or traverse fibers in the uppermost ply are eliminated. In this manner it is also insured that in the region in which the bundles of filaments are employed either as longitudinal or traverse filaments, and in the region which are formed of single filaments only, practically no differences as to the strength and stability will result. Theoretically, the most advantageous construction is when a bundle of component filaments is represented by a single filament divided in a corresponding number of parts.

The component filaments of the bundle which is bound in the tie point in the uppermost ply of the screen fabric is placed above at least one traversely directed single filament in the latter where it replaces the longitudinal single filament of the uppermost ply whereby this single filament is directed below a corresponding traverse filament in the underlying ply where it takes place of the tying component filament.

This solution is particularly advantageous in view of a marking-free structure of the upper side of the screen. The tying component filament from the bundle is not applied at the tie point in the uppermost layer in addition to existing longitudinal or traverse filaments, but occupies a place which has been vacated by a longitudinal or traverse single filament in the uppermost ply. The replaced single filament can be guided between the adjacent plies of the screen fabric namely in a two-ply fabric between the uppermost and the lowermost ply. However, it is of particular advantage when the replaced single filament is interwoven in the lowermost ply in lieu of the component filaments of the bundle. In the latter case a so-called double or clamping bind is achieved in which in a tie point both the binding of a component filament in the uppermost ply and also the binding of a corresponding portion of a longitudinal or traverse filament from the uppermost ply takes place in the lowermost one.

In order to protect the binding filaments against premature wear the single filament from the uppermost ply is shielded by the component filaments of the bundle.

In a further modification, respective component filaments in a bundle are alternately employed for tying up the other plies at different tie points. In this manner, a unilateral load of a single component fiber in a bundle is avoided and a tension in the screen is counteracted and the overall bind between the plies of the screen fabric is improved.

In the preferred embodiment of this invention the uppermost ply is fine meshed and made of filaments which are of relatively smaller cross-section or diameter than the filaments in the lowermost ply and the latter is designed as a traverse filament run. The resulting dewatering screen meets all requirements put on the forming upperside of the screen with regard to retention, dewatering and/or the lack of markings, but also in the range of the lower side where an increased wear resistance is achieved by the traverse filament or shute run. In such a screen constructed as a cross-filament run the running side is designed substantially of shute filaments whereas the warp or longitudinal filaments recess toward the interior of the screen against the tangential plane defined by the traverse or shute filaments. In this manner the paper web forming upper side of the dewatering screen is unaffected by the tie points and as mentioned before, due to binding of a component filament in the uppermost ply and simultaneously by binding a corresponding portion of the warp filament from the uppermost ply in the lowermost one, a two-fold binding per a tie point is achieved. Accordingly, an increased stability of the screen fabric and durability of the binding points between the plies and of the entire dewatering screen is obtained.

The novel features which are considered as characteristic for the invention are set forth in particular in the appended claims. The invention itself however both as to its construction and its method of operation together with additional objects and advantages thereof will be best understood from the following description of specific embodiments when read in connection with the accompanying drawing.

The threads used as longitudinal and traverse filamentary elements or filaments in the screen of the invention, have the form of a multi-filament (i.e., a twisted yarn composed of many very fine continuous strands) or of a mono-filament (i.e. a filament which consists of one relatively large continuous strand) or of a staple-filament (i.e. twisted yarn spun from relatively short staple fibers). In other words the threads are mono- or multi- or staple-filaments.

According to the invention, some of these threads have the form of a non-twisted bundle of component filaments.

Such a bundle consists of some component filaments being in closely packed arrangement but not fixed or twisted with each other. Each of the component filaments of a bundle can be handled separately and independently one from the other during the weaving. The component filaments per se are mono-filaments or multi-filaments or staple-filaments as described above.

BRIEF DESCRIPTION OF THE DRAWING

FIG. 8 is a sectional side view similar to FIG. 3 of a sixth embodiment;

FIG. 9 is a sectional side view similar to FIG. 2 of a sixth embodiment;

FIG. 10 is a sectional side view, similar to FIG. 3, of a seventh embodiment; and FIG. 11 is a sectional side view, similar to FIG. 2, of the seventh embodiment.

DESCRIPTION OF THE PREFERRED EMBODIMENTS

Figures 1, 2, 3:
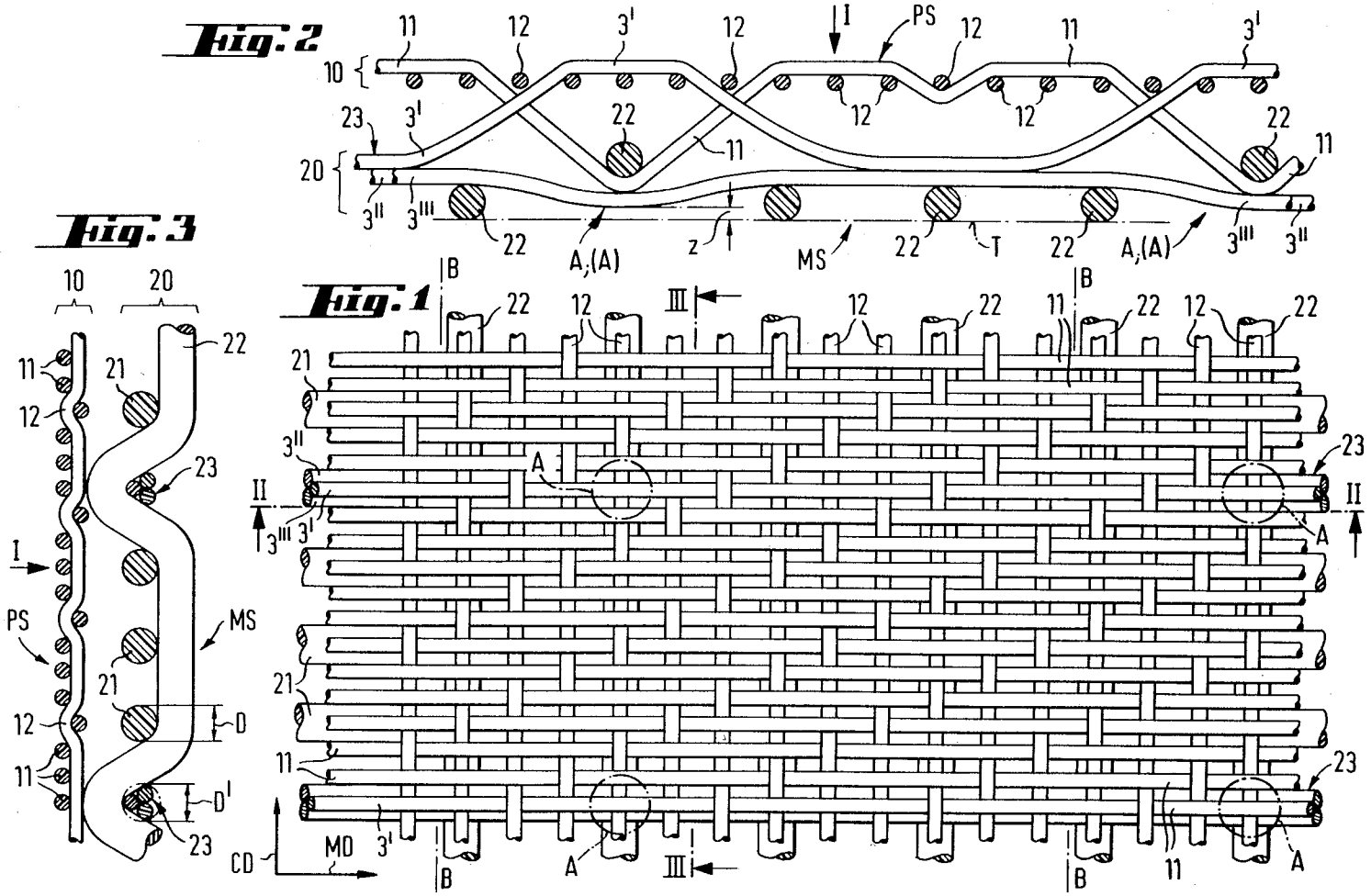
FIG. 1 is a plan view of a cut-away part of a first embodiment of the dewatering screen of this invention, showing a paper web forming side when viewed in direction of arrow I in FIGS. 2 and 3.
FIG. 2 is a sectional side view in the direction of longitudinal or warp filaments of the screen, taken along the line II—II in FIG. 1.
FIG. 3 is a sectional side view in the direction of traverse or shute filaments of the screen, taken along the line III—III in FIG. 1.

In the drawings, there is always illustrated a two-ply screen constituted by two interwoven plies of fabric applicable for example as a dewatering screen for a paper web forming part of a paper making machine. This forming screen (wire) for a pape making machine is woven of synthetic mono-filaments, for example of polyester and/or polyamid filaments. The filaments which extend in the main direction MD or direction of course of the paper making machine are called longitudinal or warp filaments and those filaments extending traversely to the warp filaments in the direction CD are called shute or cross-filaments. In a flat or open woven fabric which is later connected by seams in an endless bolt the longitudinal filaments are the warp filaments extending in longitudinal direction during the manufacture of the fabric whereas the traverse elements are the shute or weft filaments which are inserted between the taut held warp. In circular or endless weaving in contrast the warp filaments extend in the CD direction and the weft or shute filaments in the machine direction MD of the dewatering screen. Therefore in circular woven screens the warp filaments are the traverse elements and the shute or weft filaments are the longitudinal filaments.

Referring now to FIGS. 1, 2 and 3, the illustrated dewatering screen for paper making machines is made of a two-ply fabric including an upper ply 10 and a lower ply 20. The upper side of the upper ply 10 constitutes the paper web forming side or the screen upper side PS on which stuff suspension is applied and on which the paper web or stuff fleece is formed. The lower side of the lower ply 20 forms the running or track side MS of the screen which engages assigned parts of the paper making machine, such as rollers, suction and deviation devices over which the screen is moved. In the figures a mono-ply fabric is provided in each of the two plies. If desired, it is also possible to employ more than double ply fabric. In the shown embodiment, the two plies are not identical but have a different construction with regard to different requirements which are put to the upper side PS of the screen and on the lower side MS of the latter.

The upper ply 10 is a comparatively fine mesh and dense fabric. In this example, the dewatering screen is woven of a system of longitudinal and traverse synthetic mono-filaments for example of polyester and/or polyamid filaments in a four-leaved twill bind (i.e. quadruple twill weave). The longitudinal and the traverse filaments have for example the thickness or diameter of about 0.015 centimeters at the density of 46 longitudinal filaments per centimeter and a density of 36 traverse filaments per centimeter. In the binding periodicity of this four-leaved twill configuration of the upper ply 10 each traverse filament 12 is interwoven with a longitudinal filament 11 whereby the tie points are arranged obliquely one after the other. In the top side or paper forming side PS of the upper ply 10 the longitudinal filament 11 predominate passing always over three traverse filaments 12. The upper ply 10 therefore is a longitudinal filament twill.

The lower ply 20 of the screen fabric is also woven of systems of longitudinal and traverse filaments in a four-leaved twill. In the lower side or track side MS of the dewatering screen the traverse filaments 22 predominate passing always under three longitudinal filaments 21. The lower ply 20 of the screen fabric is therefore a longitudinal filament twill, or with regard to the arrangement of the paper making machine a traverse filament run; in other words, the screen bears or runs on traverse filaments. The traverse filaments are worn off by abrasion before the longitudinal filaments when as indicated in FIG. 2, the longitudinal filaments 21 or the component filaments 3 of a bundle 23 are spaced apart from an imaginary tangential line T touching the outermost points of the traverse filaments 22, about a clearance z (FIG. 2). The density of filaments and the count of filaments per centimeter in the coarse and open construction of the lower ply 20 is different from those in the upper ply 10. For example, the traverse filaments have a diameter of 0.030 centimeters and are arranged with a density of 18 traverse filaments per centimeter, and the longitudinal filaments have a thickness or diameter of about 0.030 centimeters and are arranged with a density of 23 longitudinal filaments per centimeter.

Some of the longitudinal filaments 21, in this example each fourth filament, are in the form of bundles 23 of component filaments 3. Each bundle 23 consists of a plurality of component filaments 3', 3'', 3''' oriented in longitudinal direction and arranged parallel side by side without being twisted or twined. The diameter of each of the component filaments 3 equals to the diameter of a longitudinal filament 11 in the upper ply 10. The cross-section or diameter D' (FIG. 3) of each bundle 23 corresponds approximately to the cross-section or diameter D (FIG. 3) of the longitudinal filaments 21 in the lower ply 20. The configuration of the cross-section or of the cross-sectional surface of the longitudinal filaments 21 does not correspond exactly to the cross-sectional configuration or cross-sectional area of the bundle 23. In other words, the cross-sectional area of the bundles 23 which is the sum of cross-sectional areas of individual component filaments 3, is slightly less than the cross-sectional area of the longitudinal single or mono-filaments 21. On the other hand, the bundles 23 exhibit in comparison with longitudinal mono-filaments 21 a slightly greater flexibility provided that the materials of the two filamentary elements are the same. Nevertheless, these differences are so small that a negative effect on the strength and stability of the lower ply of the screen fabric is negligible. The component filament 3 of the bundles 23 similarly as the longitudinal and traverse filaments 21 and 22 of the lower ply 20 are synthetic mono-filaments for example of polyester or polyamid.

The tie-up of the upper ply 10 to the lower ply 20 is always affected by one of the component filaments 3 of the bundle 23. This component filament 3 at a tie point in the upper ply 10 passes over 3 traverse filaments 12 and in this manner the upper ply 10 is tie. In the cutaway portion of the dewatering screen as illustrated in FIG. 1, there are two tie points A within the indicated repeat B-B of design of the dewatering screen. In these tie point A in the first embodiment a double or clamping tie is shown. It will be seen from FIG. 2, one component filament 3' of the bundle 23 is diverted to pass over 3 traverse filaments 12 in the upper ply 10 in the fashion of a longitudinal filament 11 of the upper ply whereas a corresponding portion of the longitudinal filament 11 from the upper ply is diverted downward to pass below a traverse filament 22 in the lower ply 20 to take place in the bundle 23 of the upwardly directed portion of the component filament 3'. The diverted portion of the longitudinal filament 11 is shielded from the lower side MS of the screen by the two remaining component filaments 3'' and 3''' which are generally offset from the tangential line T (FIG. 2).

The tie points A are situated along the bundles 23 of component filaments 3', 3'' and 3''' at locations at which two component filaments 3'' and 3''' which are closer to the lower or machine side MS of the screen pass under traverse filaments 22 of the lower ply 20. The remaining component filament 3' is deviated upwards to pass over 3 tranverse filaments 12 in the upper ply 10 of which the intermediate one is situated above the traverse filament 22 in the lower ply under which the remaining filaments are guided. At the same time, the longitudinal or warp filament 11 in the upper ply 10 before each tie point A is deviated dowwards to pass under the traverse filament 22 in the lower ply in contact with two component filaments and 3'' and 3''' which form a shield with respect to the machine side MS of the screen. Then both the tying component filament 3' an the corresponding longitudinal filament 11 are returned to their normal positions in respective plies. The thickness or cross-section of the tying component filament 3' corresponds to that of the longitudinal filament 11. By virtue of this double or clamping bind of the two piles 10 and 20, that means by the replacement of a portion of the longitudinal filament 11 by a portion of the component filament 3' (the latter being identical not only as their cross-section but also as to the material quality and configuration), a particularly stable and twist free binding of the two plies 10 and 20 of the screen fabric is obtained without introducing any interfering factors in the forming upper side PS of the screen (see FIGS. 2 and 3). It will be seen from FIG. 1 that the shown tie points A (two along each of the bundles 23) are inconspicuous in the overall pattern of the screen fabric. It will be also seen from FIG. 2 that of the consecutive tie points A, one employs a component filament 3' whereas the other one employs another component filament 3'' to replace the longitudinal mono-filament 11 in the upper ply.

The paper web forming screen according to the first embodiment distinguishes by the following features:

the forming or upper side PS of the screen is determined exclusively by the upper ply 10 and is not disturbed by the binding filaments from the lower ply 20, especially with regard to its marking quality which is not impaired;

the lower or machine side MS of the screen is determined exclusively by the lower ply 20 and is also undisturbed by the binding or tie filaments;

by an inconspicuous and stable construction of tie points between the upper and lower plies 10 and 20 which improves the service life of the screen particularly due to the elimination of any undulations on the dewatering screen and guarantees a mechanical stability and planar position of the latter.

Figures 4, 5, 6, 7:
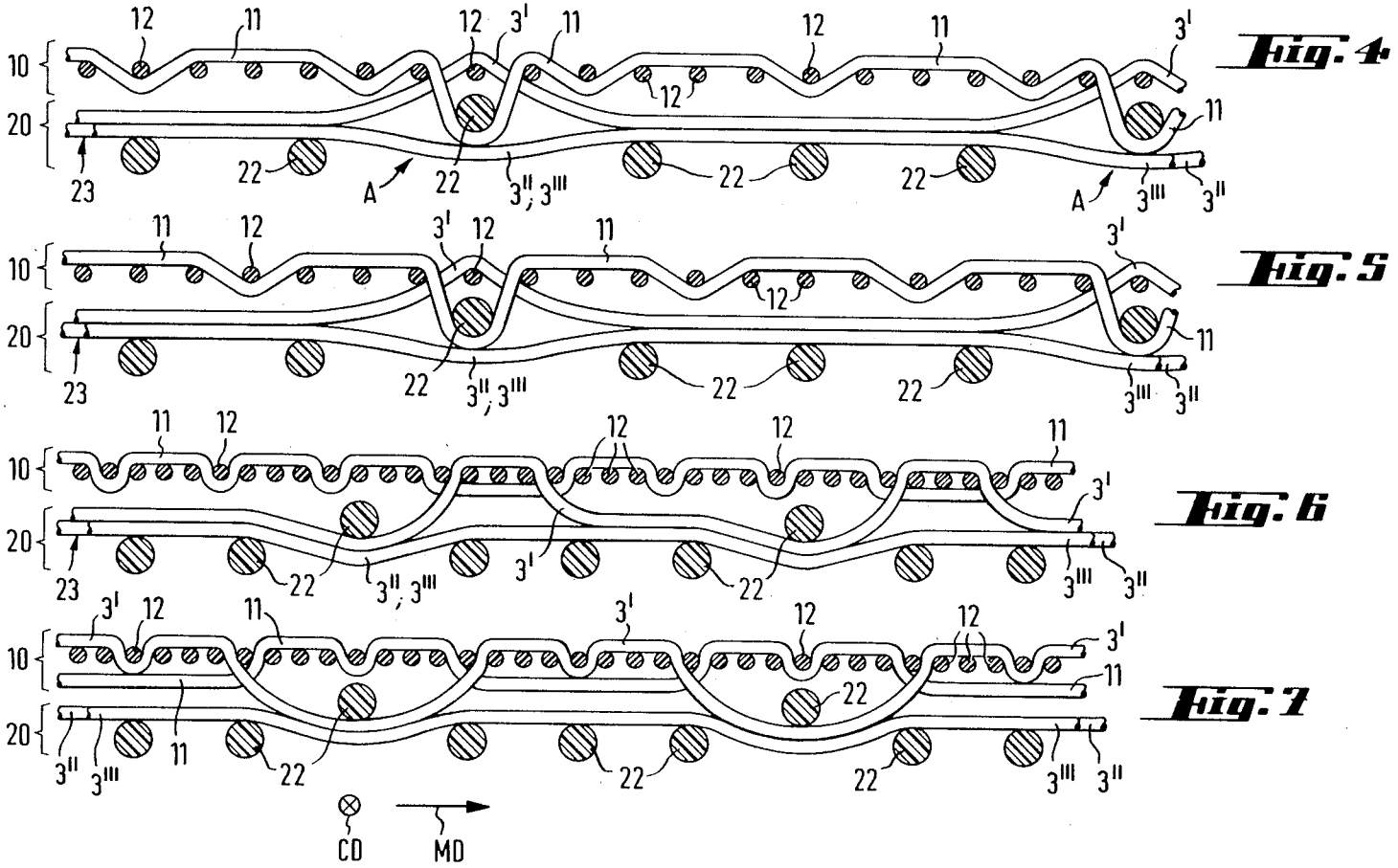
FIG. 4 is a sectional side view similar to that of FIG. 2 of a second embodiment of the screen of this invention.
FIG. 5 is a sectional side view similar to FIG. 2 of a third embodiment of the screen of this invention.
FIG. 6 is a sectional side view similar to FIG. 2 of a fourth embodiment.
FIG. 7 is a sectional side view similar to FIG. 2 of a fifth embodiment.

The embodiments of FIGS. 4 and 5 are modifications of the embodiment of FIG. 2. These modifications differ only by the range of tie points in the upper ply 10, where the component filaments 3 pass over a single traverse filament 12 which is located immediately above the traverse filament 22 in the lower ply under which the longitudinal filament 11 from the upper ply is diverted. The component filaments 3'' and 3''' of the bundle 23 protect the binding portion of the longitudinal filament 11 from the lower side of the screen. These modifications also provide double or clamping binds between the two plies 10 and 20 in which the length of the binding or tying portions in the interspace between the plies is shorter. In the embodiment of FIG. 4, the longitudinal mono-filament 11 passes traverse filaments 12 in the upper ply 10 which are adjacent to the tie points A. In this manner, the forming surface of the screen in the vicinity of tie points is slightly reduced. On the other hand, in the embodiment of FIG. 5 the longitudinal mono-filament 11 at each side of the tie point passes over three traverse filaments 12 and therefore a larger bearing surface in the vicinity of the tie points is achieved.

The embodiments according to FIGS. 6 and 7 differ from the preceding embodiment by a different kind of binding. Instead of a double or clamping bind, there is provided at tie points A only a simple bind by component filament 3' of the bundle 23 tying the upper ply 10. Also in these embodiments of FIGS. 6 and 7 the binding component filament 3' at the tie points A in the upper ply take place of the longitudinal mono-filament 11 over the traverse mono-filaments 12. In the embodiment of FIG. 6 however the longitudinal mono-filament 11 is not diverted below the traverse filament in the lower ply but instead it is passed at the tie point below the traverse mono-filaments 12 opposite the binding portion of the component filament 3'. This variation similarly as in the preceding examples, avoids any disturbances in the upper side PS of the screen.

The embodiment of FIG. 7 is a variation of the embodiment of FIG. 6 where a component filament 3' of the bundle 23 is layed under a traverse filament 22 in the lower ply 20 and then interwoven over three traverse mono-filaments 12 in the upper ply, then passes under a single mono-filament 12 then again over three subsequent mono-filaments 12 in the upper ply. In this manner, a denser arrangement of longer binding knuckles is achieved.

In all preceding examples the binding between the upper ply 10 and the lower ply 20 at each tie point occurs exclusively via a component filament 3 of bundles 23 which replace longitudinal mono-filaments 21 in the lower ply.

In the following embodiments according to FIGS. 8 and 9, the bundles 23 of component filaments 3 replace some of the traverse filaments 22 in the lower ply 20 and the binding filaments between the two plies extends in traverse direction.

The embodiment according to FIGS. 8 and 9 is similar to FIG. 5 except the lower ply 20 contains longitudinal mono-filaments 21 only whereas traverse filaments are constitued by mono-filaments 22 alternating with bundles 23 whose component filaments 3' extending in traverse direction CD provide for the binding the two plees. In other words, in contrast to the preceding embodiments, the lower ply contains longitudinal mono-filaments 21 only while the bundles 23 are replacing some of the traverse mono-filaments.

The embodiment according to FIGS. 10 and 11 is a variation which combines bundles of filaments 23 both in the traverse direction CD with bundles 23 extending in longitudinal direction MD whereby component filaments of respective traverse and longitudinal bundles are employed in the tie points between the two plies of the screen fabric.

It will be understood that each of the elements described above may also find a useful application in other types of constructions differing from the types described above.

While the invention has been illustrated and described as embodied in specific constructions of paper web forming screens for use in paper manufacturing machines, it is not intended to be limited to the details shown since various modifications and structural changes may be made without departing in any way from the spirit of the present invention.

Without further analysis the foregoing will so fully reveal the gist of the present invention that others can by applying current knowledge readily adapt it for various applications without omitting features that from the standpoint of prior art fairly constitute essential characteristics of the generic or specific aspects of this invention.

What is claimed as new and desired to be protected by Letters Patent is set forth in the appended claims:

1. A multi-ply dewatering screen for use in a paper making machine, comprising at least two fabric plies made of longitudinal and traverse filamentary elements whereby the top side of the normally upper ply represents the top side of the screen and the lower side of the lowermost ply represents the machine side of the screen; the plies being tied together at different tie points; the longitudinal and traverse filamentary elements in the upper ply being mono- or multi- or staple-filaments; a part of the longitudinal and/or traverse filamentary elements in the lowermost ply being mono- or multi- or staple-filaments and another part being in the form of non-twisted bundles of component filaments; the thickness of each bundle corresponding substantially to the thickness of the mono- or multi- or staple-filaments in the lowermost ply; said the points between the plies being formed, respectively, by passing a component filament of a bundle over at least one crossing mono- or multi- or staple-filament in the upper ply and diverting a corresponding mono- or multi- or staple-filament in the upper ply under the crossing mono- or multi- or staple filaments in the latter and the thickness of the component filaments forming tie points in the upper ply corresponding substantially to that of the mono- or multi- or staple-filaments in the upper ply.

2. A multi-ply dewatering screen as defined in claim 1 wherein each of said bundles includes at least three component filaments.

3. A multi-ply dewatering screen as defined in claim 1 wherein said bundles of component filaments are arranged in longitudinal filamentary elements in the lowermost ply, one of the component filaments of the bundle passing at the tie point over at least one traverse mono-filament in the upper ply, and a longitudinal mono- or multi- or staple-filament in the upper ply passing at the tie point under a traverse filament in the lower ply.

4. A multi-ply dewatering screen as defined in claim 1 wherein said bundles of component filaments are arranged among traverse filaments in the lower ply, and a component filament at a tie point passing over at least one longitudinal mono- or multi- or staple-filament in the upper ply to replace in the range of the tie point a traverse mono- or multi- or staple-filament in the upper ply.

5. A multi-ply screen as defined in claim 1 wherein at prospective tie point the corresponding portion of the mono- or multi- or staple-filament from the upper ply passes under a crossing filament in the lower ply and the non-binding component filaments in the bundle shielding the corresponding portion from the machine side of the screen.

6. A multi-ply dewatering screen as defined in claim 1 wherein prospective component filaments in the bundle are alternately employed by the binding filaments in consecutive tie points.

7. A multi-ply dewatering screen as defined in claim 1 wherein the mesh of the screen fabric in the upper ply is finer than that in a lower ply.

8. A multi-ply dewatering screen as defined in claim 1 wherein the lowermost ply is in the form of a traverse filament run.

9. A multi-ply dewatering screen as defined in claim 1 wherein the lowermost ply is a four-leaved twill fabric.

10. A multi-ply dewatering screen as defined in claim 1 wherein the filamentary elements in respective plies are of synthetic material.

* * * * *

UNITED STATES PATENT AND TRADEMARK OFFICE

CERTIFICATE OF CORRECTION

PATENT NO. : 4 564 051

DATED : January 14,1986

INVENTOR(S) : Heinz Odenthal

It is certified that error appears in the above–identified patent and that said Letters Patent are hereby corrected as shown below:

In Claim 1, line 47 , cancel "the" (second occurrance) and substitute --tie--

Signed and Sealed this

Twenty-fifth Day of August, 1987

*Attest:*

DONALD J. QUIGG

*Attesting Officer*

*Commissioner of Patents and Trademarks*